US009675191B2

(12) United States Patent
Kurabe et al.

(10) Patent No.: US 9,675,191 B2
(45) Date of Patent: Jun. 13, 2017

(54) STOPPER FOR BEVERAGE CONTAINER

(71) Applicants: THERMOS L.L.C., Schaumburg, IL (US); THERMOS K.K., Niigata-ken (JP)

(72) Inventors: Yasuhiro Kurabe, Tsubame (JP); HongLiang Du, Tsubame (JP)

(73) Assignees: THERMOS L.L.C., Schaumburg, IL (US); THERMOS K.K. (JP)

( * ) Notice: Subject to any disclaimer, the term of this patent is extended or adjusted under 35 U.S.C. 154(b) by 0 days.

(21) Appl. No.: 14/669,434

(22) Filed: Mar. 26, 2015

(65) Prior Publication Data

US 2015/0282654 A1 Oct. 8, 2015

(30) Foreign Application Priority Data

Apr. 2, 2014 (JP) ..... 2014-076426

(51) Int. Cl.
*A47G 19/22* (2006.01)
*B65D 43/02* (2006.01)
(Continued)

(52) U.S. Cl.
CPC ..... *A47G 19/2272* (2013.01); *B65D 43/02* (2013.01); *B65D 43/163* (2013.01);
(Continued)

(58) Field of Classification Search
CPC .. A47G 19/2272; B65D 43/02; B65D 43/163; B65D 43/24; A65D 47/0871; A65D 47/08
See application file for complete search history.

(56) References Cited

U.S. PATENT DOCUMENTS 2,557,048 A * 6/1951 Haase ..... A45C 13/007 16/295
4,513,877 A 4/1985 Taguchi et al.
(Continued)

FOREIGN PATENT DOCUMENTS

| | | |
|---|---|---|
| CN | 103284450 A | 9/2013 |
| JP | 2001-149236 A | 6/2001 |
| JP | 2012-106802 A | 6/2012 |

OTHER PUBLICATIONS

European Search Report, related to Application No. 15160932.8, dated Sep. 4, 2015, 4 pages.

*Primary Examiner* — Anthony Stashick
*Assistant Examiner* — James Way
(74) *Attorney, Agent, or Firm* — Polsinelli PC

(57) ABSTRACT

A stopper for a beverage container is described. The stopper includes a stopper main body that is attached to an upper opening of a beverage container main body and includes a liquid through hole on the inside thereof; and a lid that is axially supported by a hinge shaft that is provided at an end of the stopper main body, and which opens and closes the liquid through hole in a rotational manner; the hinge shaft connects a hinge portion of the stopper main body, and right and left hinge portions of the lid; a storage portion is provided on at least one of the right and left hinge portions of the lid, and the hinge portion of the stopper main body; at least one end of the storage portion in the axis direction of the hinge shaft forms an opening; and a torsion spring is stored in the storage portion, and a cover member covers the opening of the storage portion.

7 Claims, 7 Drawing Sheets

(51) Int. Cl.
*B65D 43/16* (2006.01)
*B65D 47/08* (2006.01)

(52) U.S. Cl.
CPC .. *B65D 47/0871* (2013.01); *B65D 2251/0021* (2013.01); *B65D 2251/0081* (2013.01); *B65D 2543/00046* (2013.01)

(56) References Cited

U.S. PATENT DOCUMENTS

| | | | | | |
|---|---|---|---|---|---|
| 5,732,135 | A * | 3/1998 | Weadon | H04M 1/0216 | 16/229 |
| 6,195,431 | B1 * | 2/2001 | Middleton | H04M 1/0216 | 379/433.13 |
| 6,702,137 | B1 * | 3/2004 | Kowa | A47J 41/0027 | 215/235 |
| 6,786,353 | B2 * | 9/2004 | Gourand | A47J 36/10 | 220/826 |
| 9,150,335 | B2 * | 10/2015 | Lane | A45F 3/16 | |
| 9,211,040 | B2 * | 12/2015 | Lane | A47J 47/02 | |
| 2002/0036207 | A1 * | 3/2002 | Ohuo | A47G 19/2266 | 220/830 |
| 2006/0175331 | A1 * | 8/2006 | Lin | A47G 19/2272 | 220/254.5 |
| 2007/0251949 | A1 * | 11/2007 | Barre | B65D 47/0871 | 220/890 |
| 2011/0089059 | A1 * | 4/2011 | Lane | B65D 47/08 | 206/222 |

* cited by examiner

STOPPER FOR BEVERAGE CONTAINER

CROSS REFERENCE TO RELATED APPLICATION

This application claims the benefit of Japanese Patent Application No. 2014-076426 filed Apr. 2, 2014, which is hereby incorporated by reference in its entirety.

FIELD OF THE INVENTION

The present invention related to a stopper for a beverage container that is provided with a lid rotating mechanism.

BACKGROUND OF THE INVENTION

Stoppers for beverage containers that open and close a liquid through hole that is provided in a stopper main body in a freely rotatable manner by biasing a lid that is axially supported by an end of the stopper main body toward an opening direction using a torsion spring, are widely known. For example, Japanese Unexamined Patent Application, First Publication No. 2001-149236 discloses a stopper for a liquid container in which an internal stopper is provided in a hinged freely rotatable manner using a support shaft that is provided at an end of an external stopper, and the internal stopper is biased toward an opening direction by a torsion spring that is provided on a support shaft. In addition, in the same manner, Japanese Unexamined Patent Application, First Publication No. 2012-106802 discloses a stopper for a beverage container in which a single door cap is axially supported in a rotatable manner by a hinged connection portion that is provided in the stopper, and is biased toward an opening direction by a spring.

However, in both stoppers, the torsion spring or the like that act as biasing means are exposed to the outside, and therefore, in a case in which the torsion spring or the like becomes broken due to metal fatigue or the like, there is a concern that fragments of the torsion spring or the like will fall inside the beverage container. In addition, since the torsion spring or the like is exposed to the outside, it is detrimental to the external appearance.

SUMMARY OF THE INVENTION

A stopper for a beverage container is described. The stopper prevents accidental ingestion due to a breakage of the torsion spring, which opens and closes a lid, and improves the external appearance of a beverage container.

Another stopper for a beverage container is described. The stopper includes a stopper main body that is attached to an upper opening of a beverage container main body and includes a liquid through hole, and a lid that is axially supported by a hinge shaft that is provided at an end of the stopper main body, and which opens and closes the liquid through hole in a rotational manner, wherein the hinge shaft connects a hinge portion of the stopper main body, and a right side and a left side of a lid hinge portion are provided on the lid so as to put the hinge portion of the stopper main body between the right side and the left side of the lid hinge portion; a storage portion is provided on at least the hinge portion of the stopper main body, the left side of the hinge portion of the lid hinge portion, and the right side of the lid hinge portion; a torsion spring is stored in the storage portion; a cover member that covers an opening of the storage portion is disposed on the opening, the torsion spring and the cover member are made integral with the hinge portion of the stopper main body and the lid hinge portion using the hinge shaft; arm portions, which are provided at both end portions of the torsion spring, are respectively freely fitted into a fixed groove, which is provided in the storage portion, and a latching groove, which is provided in the cover member; and the lid is biased toward an opening direction by causing a connection portion of the cover member to abut against a connection receiving portion that is provided in one of the lid and the stopper main body which does not include the storage portion.

Another stopper for a beverage is described. In the stopper, the latching groove and the fixed groove are not exposed to an outer surface regardless of the position of the lid.

Another stopper for a beverage is described. In the stopper, an interval between the storage portion and the cover member is less than or equal to a wire diameter of the torsion spring.

Another stopper for a beverage container is described. In the stopper, the storage portion is provided on the hinge portion of the stopper main body.

Another stopper for a beverage container is described. In the stopper, the storage portion is provided on either the right hinge portion or the left hinge portion of the lid.

Another stopper for a beverage container is described. In the stopper, a lid closure prevention projection having a convex shape on the back side is formed on the back side of the outer surface of the hinge portion of the stopper main body, a thin plate-shaped lid closure prevention plate is formed on the lid; and the lid closure prevention plate abuts against the lid closure prevention projection.

In addition, a beverage container is also described. The beverage container includes any of the stoppers above.

The stoppers for a beverage container provide advantages. As described above, the torsion spring is not exposed, and therefore, an external appearance property is improved. In addition, since the storage portion is covered with the cover member, even in a case in which the torsion spring becomes broken, fragments are stopped inside the storage portion. Therefore, it is possible to reduce the risk of fragments falling outside the storage portion.

Further, the fixed groove and the latching groove, into which the arm portions of the torsion spring are freely fitted, are not exposed to an outer surface whichever position the lid is in. Therefore, even in a case in which the arm portions become broken, fragments are stopped inside the storage portion, and consequently, it is possible to reduce the risk of fragments falling outside the storage portion.

Further, the interval between the storage portion and the cover member is set to be less than or equal to the wire diameter of the torsion spring. Therefore, it is made so that broken fragments no longer fall inside the beverage container.

DETAILED DESCRIPTION OF THE INVENTION

A stopper for a beverage container will be described with reference to the appended drawings.

Additionally, the embodiments that are described below do not limit the content of the present disclosure. In addition, all of the configurations that are described below are not necessarily essential requirements of the stopper for a beverage container of present disclosure.

Example 1

Figure 1:
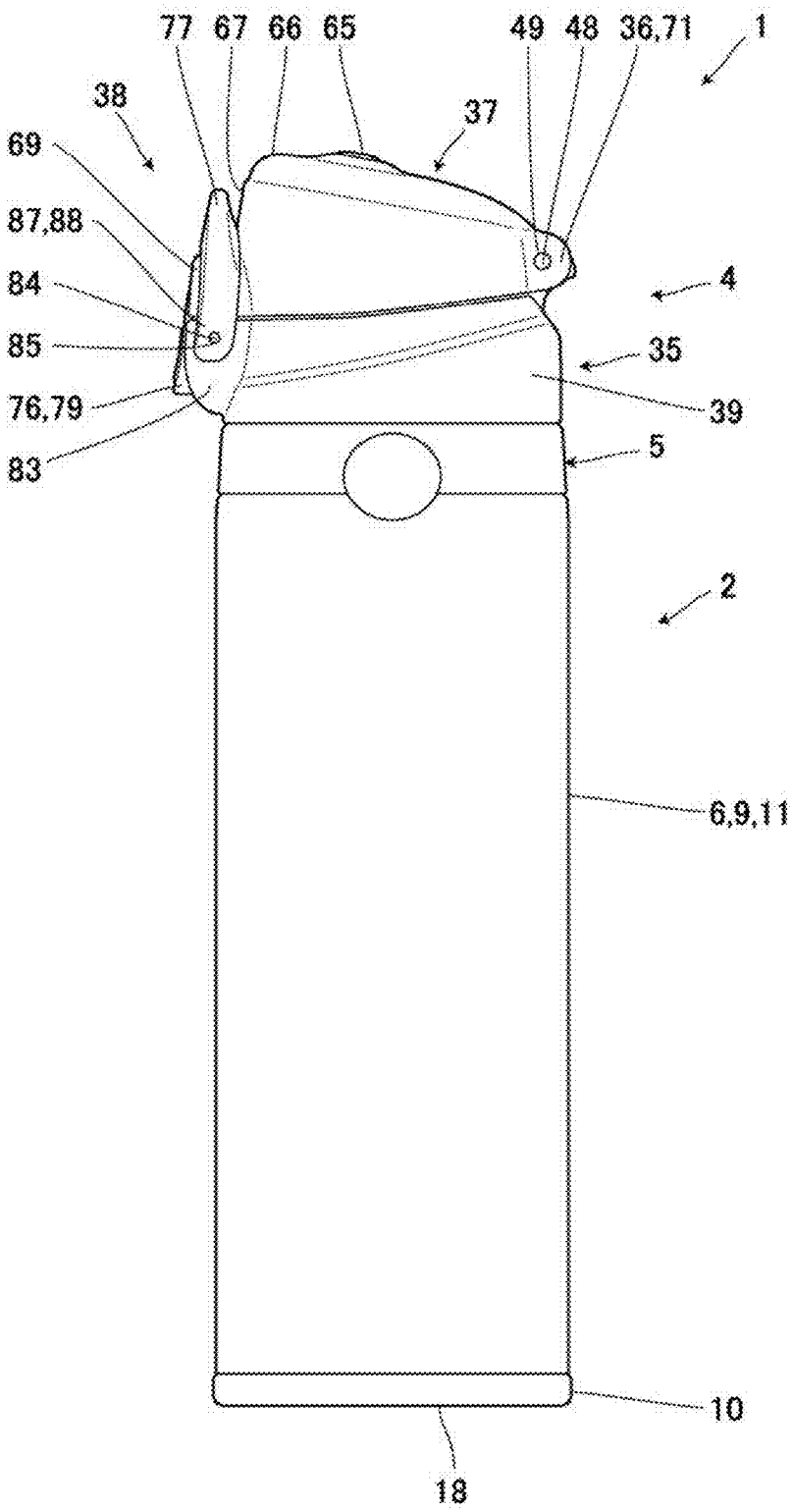
FIG. 1 is a right side view of a stopper for a beverage container according to Example 1 of the present disclosure and a beverage container.
Figure 2:
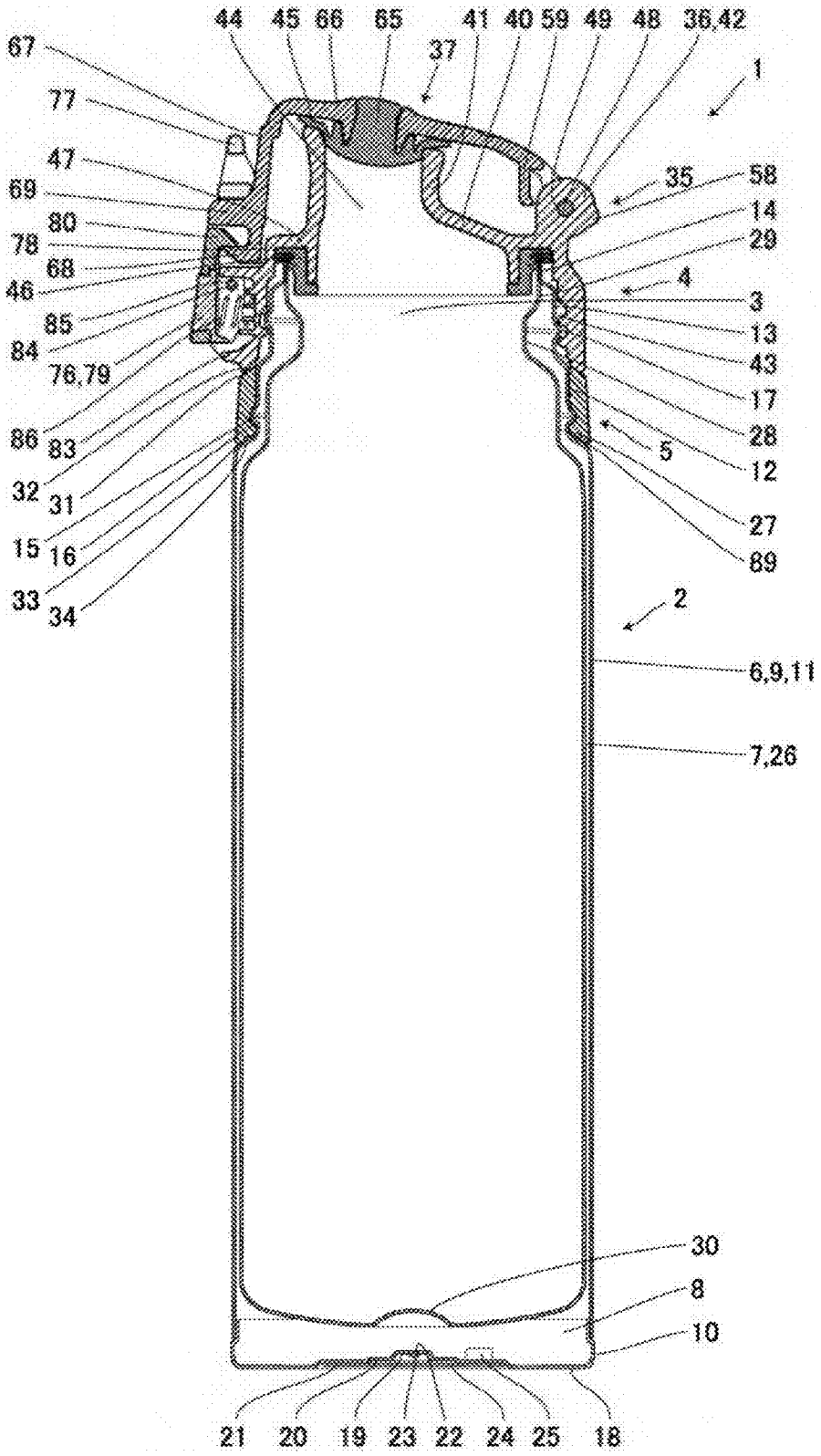
FIG. 2 is a longitudinal cross-sectional view of the stopper for a beverage container and the beverage container that are shown in FIG. 1.

FIGS. 1 and 2 show a beverage container 1. The beverage container 1 includes a beverage container main body 2 that has a metal vacuum thermal insulating structure and a size that can be held with a single hand, a stopper 4 that is attached to an upper opening 3 of the beverage container main body 2, and a shoulder member 5, which fits together with the beverage container main body 2 by being fixedly arranged below the stopper 4.

The beverage container main body 2 is configured from an outer container 6 that has a bottomed cylindrical form in which an upper portion is open, and an inner container 7 that has a bottomed cylindrical form in which an upper portion is open in the same manner, and is fixedly arranged on the inside of the outer container 6. The outer container 6 and the inner container 7 are joined in an integral manner through welding an edge of the upper opening 3, and a vacuum thermal insulating layer 8 is formed in an interval between the outer container 6 and the inner container 7. Additionally, the outer container 6 and the inner container 7 are both formed of stainless steel (for example, SUS304).

The outer container 6 has a two member structure that is formed from a tubular cylindrical portion 9 in which the top and bottom are open, and a shallow bottomed cylindrical bottom portion 10 that is joined to a lower portion of the cylindrical portion 9 by welding.

Further, the cylindrical portion 9 is configured from an outer container body portion 11 with a longitudinal tubular shape, an outer container shoulder portion 12, which has a diameter that is smaller than the outer container body portion 11 and is formed above the outer container body portion 11, an outer container neck portion 13, which has a diameter that is smaller than the outer container shoulder portion 12 and is formed above the outer container shoulder portion 12, and an outer container opening 14, which has a diameter that is smaller than the outer container neck portion 13 and is formed above the outer container neck portion 13.

A shoulder convex portion 15, which is convex on an outer side thereof is formed in the outer container shoulder portion 12. The shoulder member 5 is fitted together with the outer container shoulder portion 12 by latching onto a shoulder concave portion 16, which is formed in the shoulder member 5, with the shoulder convex portion 15.

A beverage container main body screw portion 17, which is a male screw for screwing together with the stopper 4, is formed on an outer surface of the outer container neck portion 13.

A three stage structure vertically stepped portion is formed on a bottom surface 18 of the bottom portion 10 with concentric circles. The stepped portion is configured from an upper stepped portion 19 that is formed in a central portion of the bottom surface 18, a middle stepped portion 20 that is formed with a larger diameter than the upper stepped portion 19 on an outer peripheral side of the upper stepped portion 19, and a lower stepped portion 21 that is formed with a larger diameter than the middle stepped portion 20 on an outer peripheral side of the middle stepped portion 20.

In addition to a small ventilation hole 22, a vacuum sealing material 23 that seals the ventilation hole 22 is fixedly arranged in the upper stepped portion 19. The ventilation hole 22 is in communication with an interval between the outer container 6 and the inner container 7. The vacuum thermal insulating layer 8 is formed in an interval between the outer container 6 and the inner container 7 by sealing the ventilation hole 22 with the vacuum sealing material 23 after ventilating the interval using the ventilation hole 22.

Additionally, for example, as the vacuum sealing material 23, it is possible to use a brazing metal material that is formed from Sn or an alloy of Sn and Ag, Cu, Ni, Bi or Zn, a brazing glass material or the like.

A thin disc-shaped protective plate 24 that protects the vacuum sealing material 23 from external impacts and the like is attached to the lower stepped portion 21. The protective plate 24 is formed by plastic or stainless steel, and is attached to the lower stepped portion 21 using a heat-resistant adhesive or the like.

In addition, a degasser 25 that adsorbs gas that is generated from inside the vacuum thermal insulating layer 8 is fixedly arranged on a surface that is on a vacuum thermal insulating layer 8 side of the lower stepped portion 21.

Additionally, as long as the degasser 25 is not in a position that blocks the ventilation hole 22, the degasser 25 may be fixedly arranged at any location inside the vacuum thermal insulating layer 8.

Meanwhile, the inner container 7 is configured from an inner container body portion 26, a longitudinal cross-sectional of which has a substantial U-shape, an inner container shoulder portion 27, which has a diameter that is smaller than the inner container body portion 26 and is formed above the inner container body portion 26, an inner container neck portion 28, which has a diameter that is smaller than the inner container shoulder portion 27 and is formed above the inner container shoulder portion 27, and an inner container opening 29, which has a diameter that is larger than the inner container neck portion 28 but smaller than the inner container shoulder portion 27 and is formed above the inner container neck portion 28. In addition, a circular concave portion 30, which is concave on the top thereof, is formed in a central portion of a bottom surface of the inner container 7.

The shoulder member 5 has a tubular shape in which the top and bottom are open, and is formed by a synthetic resin. A shoulder member upper end surface 31, which is an end surface of an upper side of the shoulder member 5, is inclined in a downward manner toward an outer diameter direction. The shoulder member upper end surface 31 abuts against a stopper main body lower end surface 32, which is an end surface of a lower side of a stopper main body which will be described later. A shoulder member lower end surface 33, which is an end surface of a lower side of the shoulder member 5, is also inclined in a downward manner toward an outer diameter direction. The shoulder member lower end surface 33 abuts against an outer container inclined portion 34 that is formed between the outer container body portion 11 and the outer container shoulder portion 12 of the beverage container main body 2. In addition, a shoulder member stepped portion 89 having a rectangular shape in longitudinal cross-sectional view is formed on an inner diameter side of the shoulder member lower end surface 33. Furthermore, the shoulder concave portion 16, which latches onto the shoulder convex portion 15 that is formed in the outer container shoulder portion 12, is formed on an inner side of the shoulder member 5.

Figure 3:
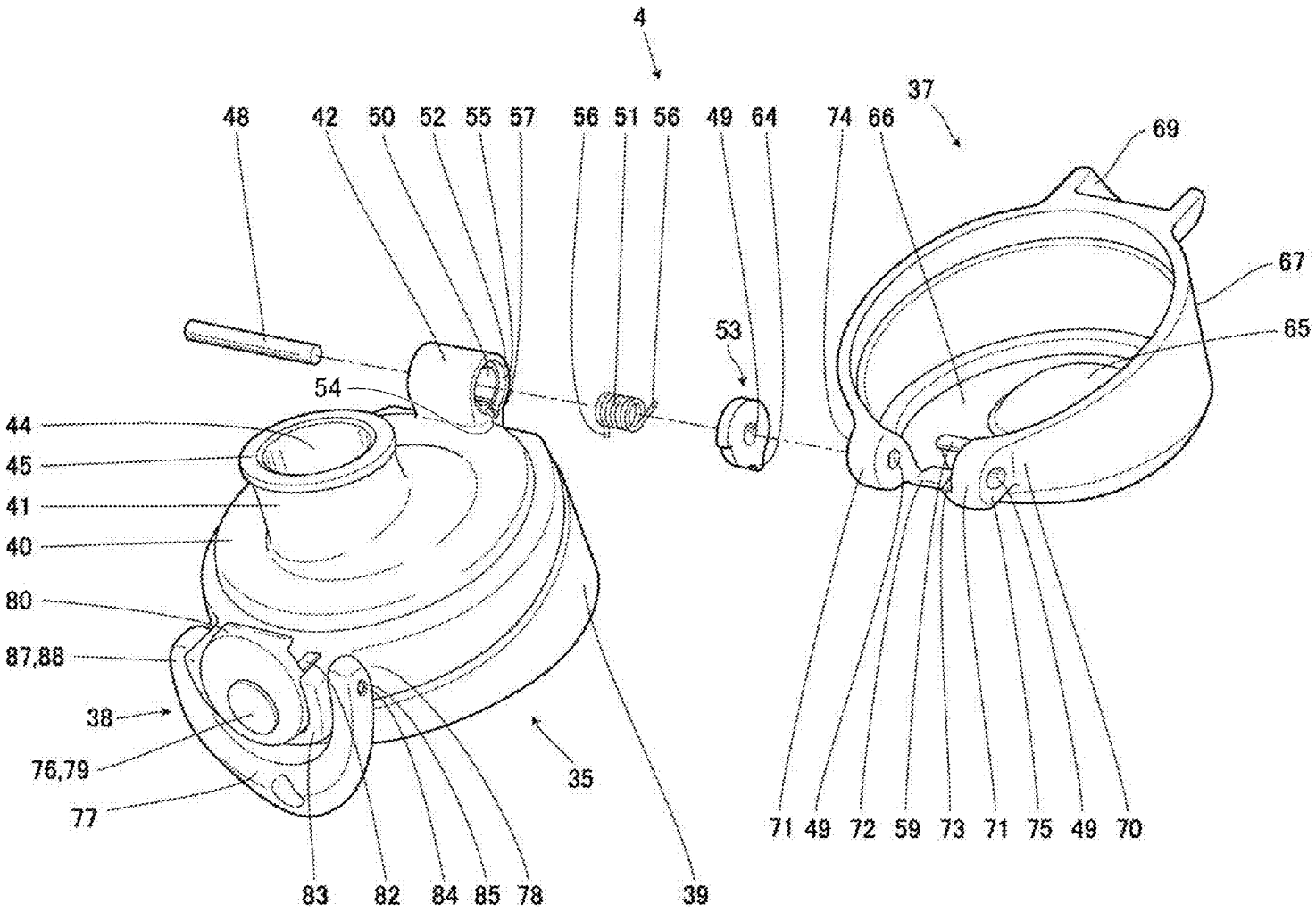
FIG. 3 is an exploded perspective view of the stopper for a beverage container that is shown in FIG. 1.

Hereinafter, a detailed explanation of the stopper 4 will be given with reference to FIGS. 3 to 8 in addition to FIGS. 1 and 2. For example, as shown in FIG. 3, the stopper 4 includes a stopper main body 35 that screws together with the outer container neck portion 13, a lid 37 that is bonded to the stopper main body 35 in a rotational manner using a hinge portion 36, which is provided on a part of the stopper main body 35, and a locking mechanism 38 which is positioned to be opposite to the hinge portion 36 in a radial direction and retains the lid 37 while closing the lid 37 provided on the other side of the stopper main body 35.

Hereinafter, a locking mechanism 38 side will be referred to as a front side of the stopper 4, a hinge portion 36 side will be referred to as a back side of the stopper 4, a left side when viewing from the locking mechanism 38 side will be referred to as a left side of the stopper 4, and a right side when viewing from the locking mechanism 38 side will be referred to as a right side of the stopper 4.

The stopper main body 35 has an inverse bottomed tubular-shape that is formed from a tubular portion 39, which has a substantially cylindrical shape and screws together with an outer side of the outer container neck portion 13; and a stopper main body top panel portion 40 that covers the upper opening 3 of the beverage container 1. A spout 41, which has a cylinder shape in which the top and bottom are open, is formed in a protruding manner in the vicinity of the front side of the stopper main body top panel portion 40. In addition, a hinge portion 42 of the stopper main body 35, which has a recumbent substantial cylinder shape, is fixedly arranged on a back side of the upper surface of the stopper main body top panel portion 40. The stopper main body 35 is formed using a synthetic resin.

A screw portion 43, which has a female screw shape, and screws together with the beverage container main body screw portion 17 that is formed on the outer container neck portion 13, is formed on an inner surface of the tubular portion 39.

The spout 41 is formed in a protruding manner in a substantially columnar shape from the stopper main body top panel portion 40. The spout 41 has a thickness that a user can fit into their mouth, and the height thereof is a height that can be covered by the lid 37. A liquid through hole 44, which is a flow channel of a beverage that flows in the beverage container main body 2, is formed in an inner portion of the spout 41. A spout upper end surface 45, which is an end surface of an upper side of the spout 41, is formed to be inclined so that a back side thereof is low, and has substantially the same angle as the stopper main body top panel portion 40 of the lid 37.

A stopper main body sealing member 46, which is a packing that prevents water between the upper opening 3 of the beverage container main body 2 and the stopper 4 in a watertight manner, is provided on an inner side of the tubular portion 39 of the stopper main body 35. The stopper main body sealing member 46 is detachably attached to a concave portion for attachment 47 that is provided on an inner surface of the stopper main body 35. Additionally, the stopper main body sealing member 46 is formed by elastomer, rubber or an elastic synthetic resin.

A hinge shaft hole 49, which is a penetration hole for the insertion of a hinge shaft 48 in a horizontal direction, is formed in the hinge portion 42 of the stopper main body 35. A first storage portion 50, a right side of which is open, is formed in an inner portion of the hinge portion 42 of the stopper main body 35. The first storage portion 50 is a concave portion with a substantially circular shape in which a diameter is greater than that of the hinge shaft hole 49. A torsion spring 51 for biasing the lid 37 toward an opening direction, is stored in the first storage portion 50, and a storage opening 52 of the first storage portion 50 is blocked by a cover member 53, which will be described later. In other words, in the present example, the opening 52 is formed on the right side of an axial direction of the hinge shaft 48 in the hinge portion 42 of the stopper main body 35, and the opening is blocked by the cover member 53.

A cover receiving portion 55, which is a concave portion that has a substantially circular shape in which the diameter is greater than that of the first storage portion 50, is formed on an end surface 54 of the hinge portion 42 of the stopper main body 35, which is a surface that is on an storage opening 52 side of the first storage portion 50. The cover member 53 is inserted into the cover receiving portion 55 with some leeway.

In addition, a fixed groove 57 that has a micro groove-shape is formed on a lower side of the first storage portion 50, which is an inner portion of the hinge portion 42 of the stopper main body 35. A side of an arm portion 56 of the torsion spring 51 is inserted into the fixed groove 57 with some leeway. When the torsion spring 51 is stored in the first storage portion 50, the orientation of the arrangement of the torsion spring 51 is determined by arranging the side of arm portion 56 to match a position of the fixed groove 57.

Figure 4:
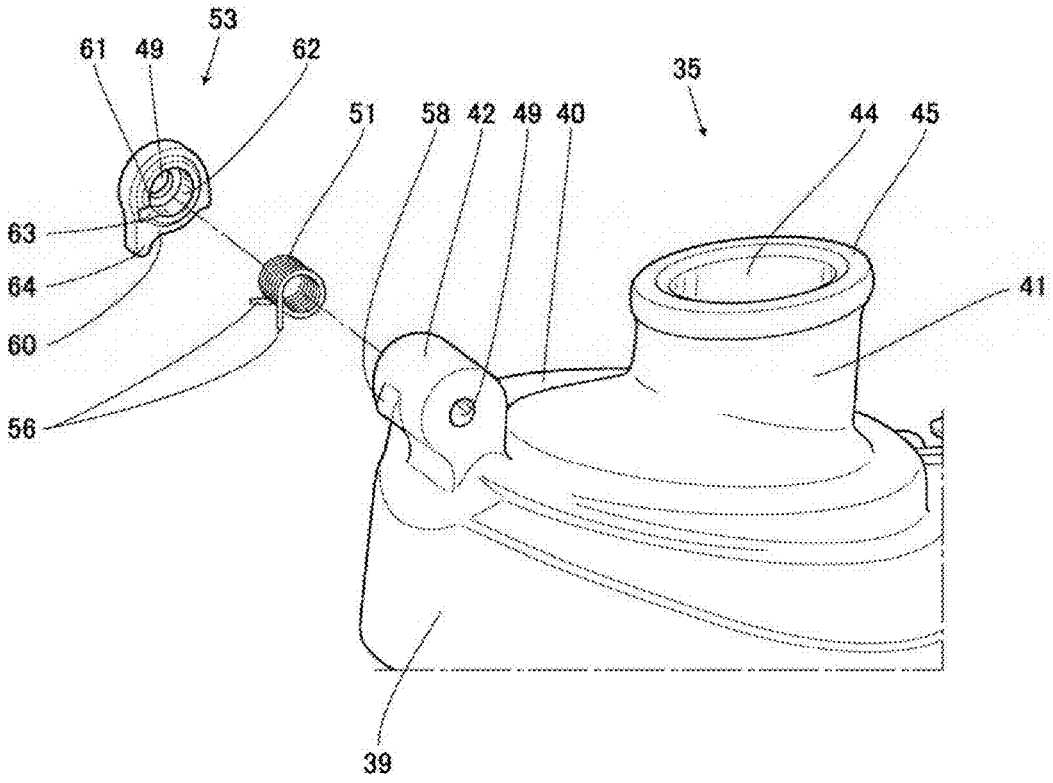
FIG. 4 is an exploded perspective view of a cover member, a torsion spring and a stopper main body in the stopper that is shown in FIG. 1.

As shown in FIG. 4, a lid closure prevention projection 58, which has a convex shape on the back side, is formed on the back side of the outer surface of the hinge portion 42 of the stopper main body 35. Since a lid closure prevention plate 59, which will be described later, abuts against the lid closure prevention projection 58, the lid 37 does not close due to its own weight even in a case in which the beverage container 1 is inclined to the front side.

In addition, as shown in FIG. 4, a ring-shaped circular rib 61, a portion of which has been notched, is formed in a protruding manner on a cover member inner surface 60, which is a surface that is on a first storage portion 50 side of the cover member 53. A second storage portion 62, which is a concave portion that has a substantially circular shape is formed on an inner side of the circular rib 61. In addition, a latching groove 63 that has a micro groove-shape is formed in the cover member inner surface 60, in a portion in which the circular rib 61 has been notched and on an outer side thereof.

After the torsion spring 51 has been stored in the first storage portion 50, if the cover member 53 is attached to the hinge portion 42 of the stopper main body 35 so that the other side of an arm portion 56 is freely fitted into the latching groove 63, a portion of the torsion spring 51 is stored in the second storage portion 62, the circular rib 61 abuts against the cover receiving portion 55, and the cover member inner surface 60 abuts against the end surface 54 of the stopper main body 35. In this state, the cover member 53 is freely fitted into the hinge portion 42 of the stopper main body 35, and becomes rotatable with respect to the hinge portion 42 of the stopper main body 35.

A connection portion 64, which protrudes in a substantially vertical direction with respect to the latching groove 63 is formed in the cover member 53 at the outer periphery thereof. A biasing force of the torsion spring 51 is transmitted to the lid 37 as a result of the connection portion 64 abutting against the lid 37.

In addition, the hinge shaft hole 49, which is a penetration hole for the insertion of the hinge shaft 48, is formed on an inner side of the second storage portion 62, which is substantially central portion of the cover member 53. Therefore, if the hinge shaft 48 is inserted into the hinge shaft hole 49 that is formed in the hinge portion 42 of the stopper main body 35 and the cover member 53, the hinge shaft 48 is inserted into a wound inner portion of the torsion spring 51 that is stored in the first storage portion 50 and the second storage portion 62.

The lid 37 is formed in an inverse bottomed tubular-shape in which a lid top panel portion 66 is set as a bottom portion, and the spout 41 is closed using the lid 37. In addition, a lid sealing member 65, which is a packing that seals an upper portion of the spout 41 during the lid is closed, is fitted together with the lid top panel portion 66.

Additionally, the lid sealing member 65 is formed by elastomer, rubber or an elastic synthetic resin.

For example, as shown in FIG. 2, an engagement piece 68, which protrudes horizontally, is formed at a lower end of a lid front surface portion 67, and a latch reception portion 69, which protrudes horizontally, is formed above the engagement piece 68.

As shown in FIG. 3, a lid hinge portion 71, which has a substantially semicircular shape that is convex on the back side thereof, is provided with a left and right pair on a lid back side wall 70, which is a wall that is on a back side of the lid 37. The hinge shaft hole 49, which is a penetration hole for the insertion of the hinge shaft 48, is respectively formed in left and right lid hinge portions 71.

In addition, a notched portion 72 in which the lid back side wall 70 is notched, is formed between the left and right lid hinge portions 71. The hinge portion 42 of the stopper main body 35 is disposed in the notched portion 72 when the lid 37 is attached to the stopper main body 35.

In addition, a connection reception portion 73 that protrudes on a notched portion 72 side, and against which the connection portion 64 that is formed in the cover member 53 abuts, is formed in the right lid hinge portions 71.

Figure 8:
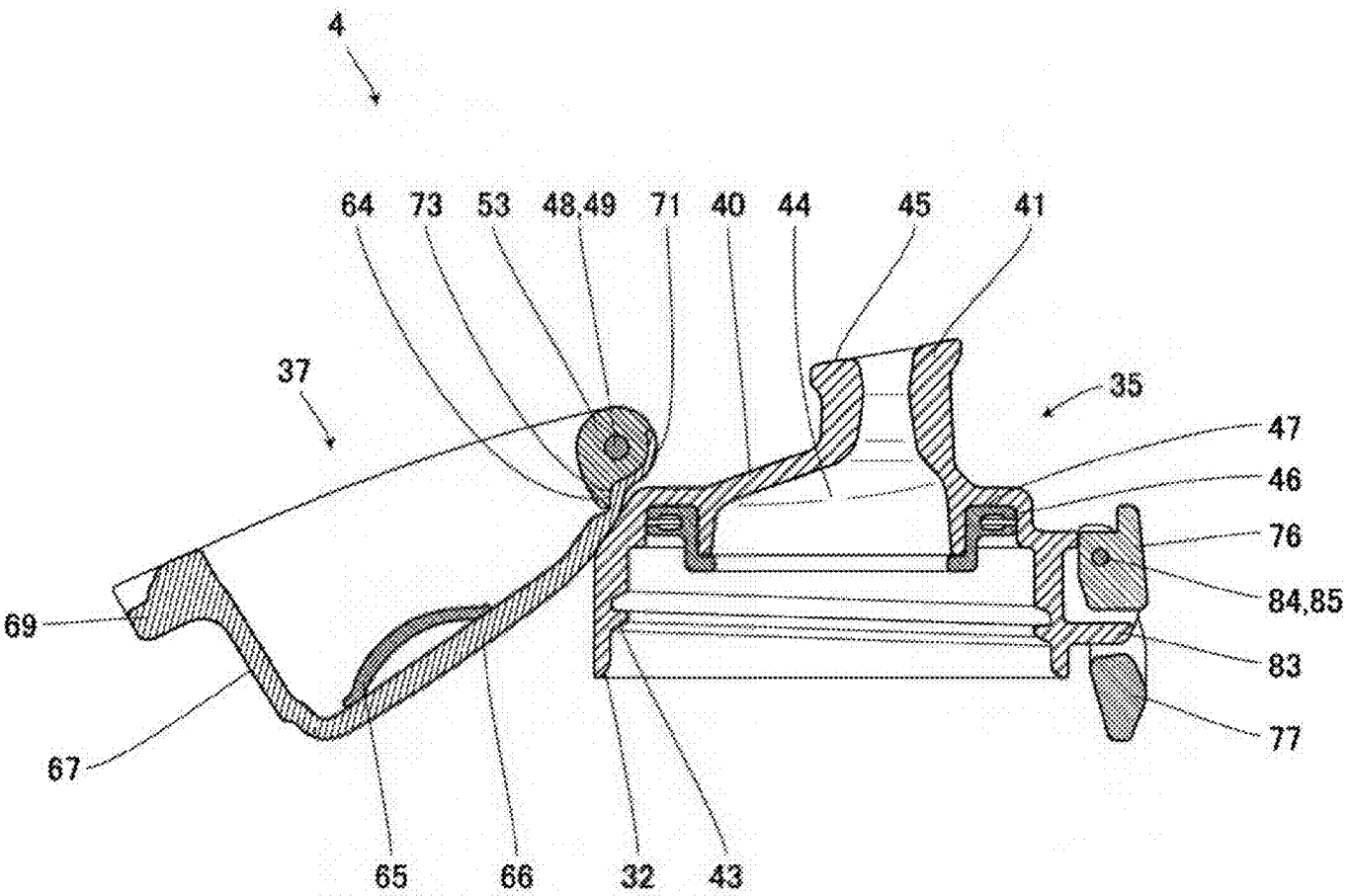
FIG. 8 is a longitudinal cross-sectional view of a stopper in a position that is shifted to a right side of the center.

Additionally, as shown in FIG. 8, the connection portion 64, which is formed in a protruding manner in the cover member 53, and the connection reception portion 73 abuts against one another at a required sufficient length, and the connection portion 64 is designed so that the connection portion 64 is shifted from the connection reception portion 73 without spinning freely when the lid 37 is opened and closed. FIG. 8 is a longitudinal cross-sectional view of a stopper 4 in a position that shows a cross section of the cover member 53 that is shifted to a right side of the center.

In addition, the thin plate-shaped lid closure prevention plate 59 is formed on a notched portion 72. If the beverage container 1 is inclined forward during an open state, the lid 37 starts to rotate in a direction of closing due to its own weight. However, since the lid closure prevention plate 59 immediately abuts against the lid closure prevention projection 58, the lid 37 does not close due to its own weight only.

Next, a detailed explanation of an attachment sequence of the lid 37 to the stopper main body 35 will be given.

Figure 5:
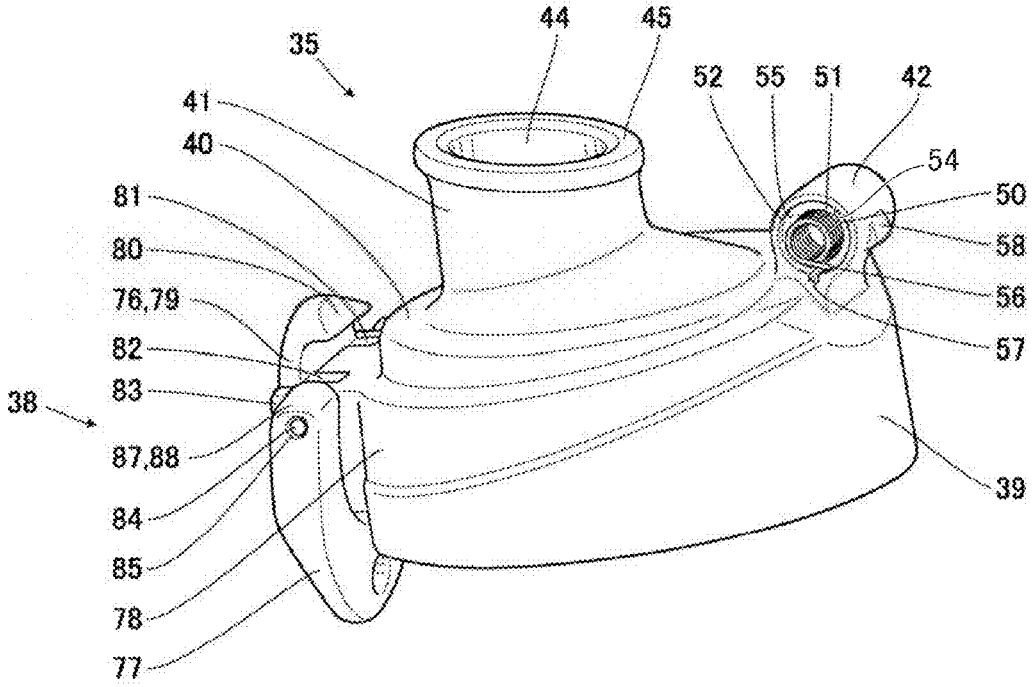
FIG. 5 is a perspective view of a stopper main body in which a torsion spring is stored.
Figure 6:
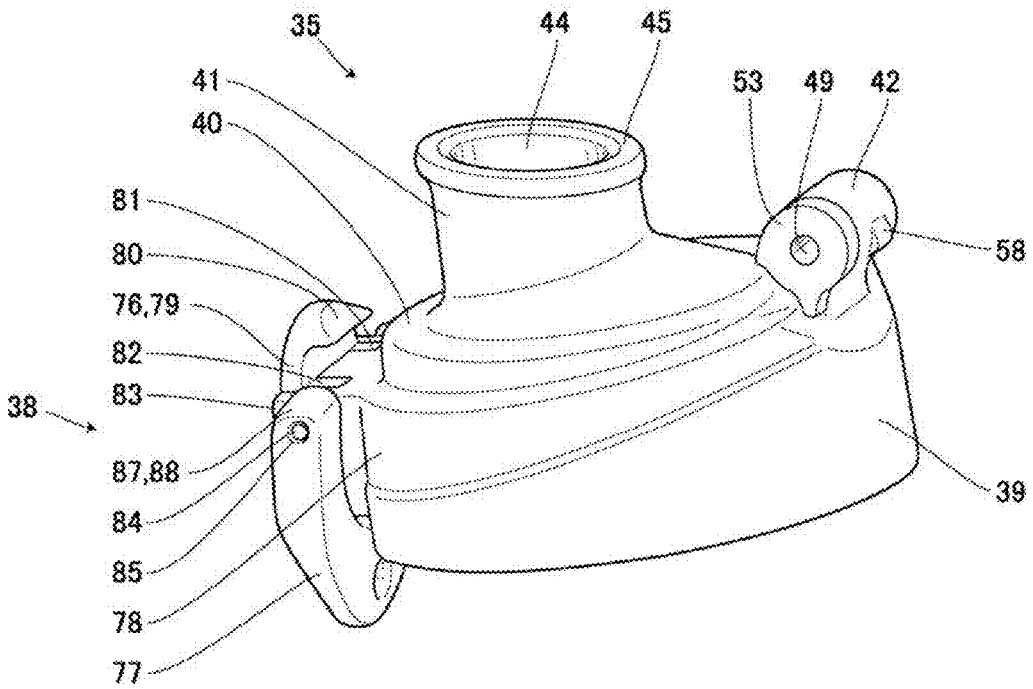
FIG. 6 is a perspective view of a stopper main body to which a cover member has been attached.

Firstly, as shown in FIG. 5, the torsion spring 51 is stored in the first storage portion 50 of the hinge portion 42 of the stopper main body 35 through the storage opening 52. The first storage portion 50 may enclose much of the torsion spring 51. Thereafter, as shown in FIG. 6, the cover member 53 is attached to the hinge portion 42 of the stopper main body 35 in a manner in which the storage opening 52 is blocked. At this time, one side of the arm portion 56 of the torsion spring 51 is stored in the fixed groove 57, and the other side of the arm portion 56 is stored in the latching groove 63. The circular rib 61 abuts against the cover receiving portion 55. The cover member inner surface 60 abuts against the end surface 54 of the hinge portion 42 of the stopper main body 35. As a result of this, it is possible to reliably accommodate the torsion spring 51 in the first storage portion 50 and the second storage portion 62.

Figure 7:
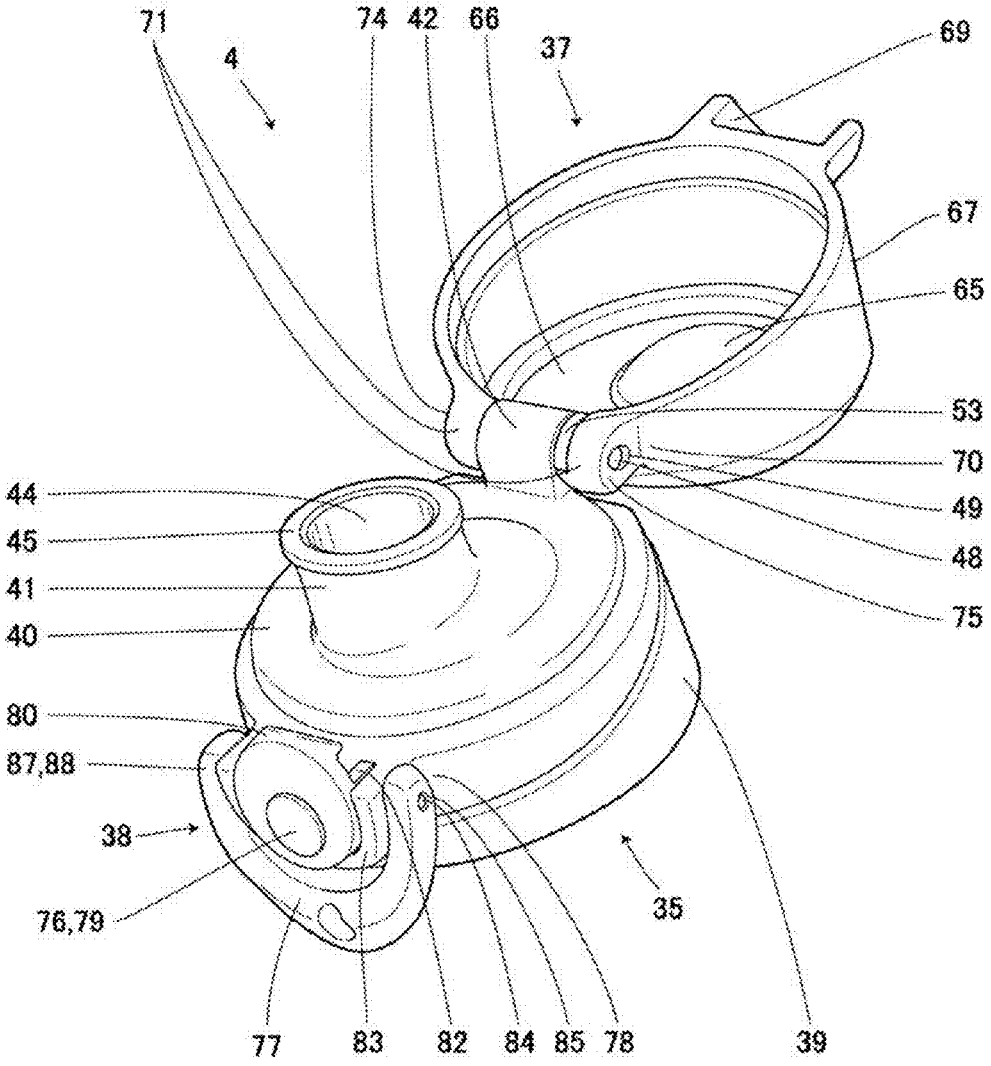
FIG. 7 is a perspective view of a stopper in an open state.

Next, the hinge portion 42 of the stopper main body 35 is disposed in the notched portion 72 of the lid 37 by causing the connection portion 64 to abut against the connection reception portion 73. Further, the hinge shaft 48 is inserted into the hinge shaft hole 49. The hinge shaft 48 horizontally penetrates the hinge portion 42 of the stopper main body 35, the torsion spring 51, the cover member 53 and the lid hinge portion 71. Thereby, as shown in FIG. 7, a stopper 4 in which the lid 37 is attached to the stopper main body 35 is formed.

The hinge shaft 48 is fixed by being inserted through the hinge shaft hole 49 that is formed in the hinge portion 42 of the stopper main body 35, and is freely fitted in the hinge shaft hole 49 that is formed in the lid 37 and the cover member 53. Therefore, the lid 37 and the cover member 53 are rotatable with respect to the stopper main body 35. In addition, in a state of being inserted into the hinge shaft hole 49, the hinge shaft 48 is formed to a length that does not protrude to the outside from a left side surface 74 and a right side surface 75, which are the left and right outer side surfaces of the lid hinge portion 71.

In this manner, since the hinge portion 42 of the stopper main body 35 and the cover member 53 are positioned between or sandwiched between the right and left lid hinge portions 71 and 71, it is not possible to see the torsion spring 51 that is stored in the first storage portion 50 and the second storage portion 62 from the outside. The torsion spring 51 may be completely or nearly completely concealed by a combination of the right and left lid hinge portions 71 and 71, the hinge portion 42, and the cover member 53.

In addition, an interval between the hinge portion 42 of the stopper main body 35 and the cover member 53 is designed so as to be narrower than a wire diameter of the torsion spring 51. Therefore, in addition to improving the design properties of the beverage container 1, it is even possible to contain fragments inside the first storage portion 50 and the second storage portion 62 in a case in which the torsion spring 51 breaks due to metal fatigue or the like.

Hereinafter, a detailed explanation of the locking mechanism 38 will be given.

The locking mechanism 38 has a double lock configuration that is provided with a locking button 76 that acts as a button, which is a first locking member, and a U-shaped lock 77, which is a second locking member.

The locking button 76, which is fixedly arranged in a front surface portion 78 of the stopper main body 35, includes a button portion 79, which is circular in plan view, an engagement portion 80, which is vertically provided in a backward manner on an upper portion rear surface of the button portion 79, a button left wall portion 81 and a button right wall portion 82, which are vertically provided on left and right rear surfaces of the button portion 79. The lid 37 is locked in a closed state as a result of the engagement portion 80 latching onto the engagement piece 68 that is provided in the lid front surface portion 67 of the lid 37.

In addition, a lock rotation shaft hole 85 is formed in upper portions of the button left wall portion 81 and the button right wall portion 82. A lock rotation shaft 84 for supporting the locking button 76 on a support portion 83, which will be described later, is inserted into the lock rotation shaft hole 85. The locking button 76 is supported in a rotatable manner by the lock rotation shaft 84. The engagement portion 80, which is provided in an upper portion of the locking button 76, advances and retreats in a front-back direction as a result of rotation of the locking button 76.

In addition, for example, as shown in FIG. 2, a spring 86, which is an elastic body for return, is fixedly arranged between a lower portion rear surface of the locking button 76 and the tubular portions 39 of the stopper main body 35. The engagement portion 80 of the stopper main body 35 is biased in a normal locked state direction by the spring 86.

In addition, the support portion 83, which has a substantial U-shape in plan view, is provided on the front surface portion 78 of the stopper main body 35 so as to surround the locking button 76 of the left and right and therebelow. The lock rotation shaft hole 85 is formed in one location on each of the left and right of an upper portion of the support portion 83 in a symmetrical manner. The lock rotation shaft hole 85 is a penetration hole for the insertion of the lock rotation shaft 84, which supports the locking button 76 and the U-shaped lock 77.

The U-shaped lock 77 has a substantial U-shape that is provided with a left and right pair of arm portions 87. The lock rotation shaft hole 85, which is a penetration hole for the insertion of the lock rotation shaft 84, is formed in one location on each of the left and right of both base end portions 88 of the arm portions 87 in a symmetrical manner. The U-shaped lock 77 is supported in a rotatable manner by the support portion 83 through the lock rotation shaft 84.

Further, when a leading end of the U-shaped lock 77 is in a first upturned position, the leading end of the U-shaped lock 77 fits onto the latch reception portion 69 that is formed in the lid 37, and therefore, the lid 37 is locked in a closed state. Meanwhile, when a leading end of the U-shaped lock 77 is in a second downturned position, the U-shaped lock 77 is in an unfitted unlocked state, and therefore, the U-shaped lock 77 is disposed so as to fit onto the support portion 83.

In this manner, the single lock rotation shaft 84 that is inserted into the lock rotation shaft hole 85 formed in the locking button 76, the support portion 83 and the U-shaped lock 77 is fixed by being fitted together with the support portion 83, and is freely fitted into the locking button 76 and the U-shaped lock 77. Therefore, the locking button 76 and the U-shaped lock 77 are rotatable with respect to the support portion 83. In addition, the lock rotation shaft 84 is formed to a length of an extent that does not protrude to both outer sides of the U-shaped lock 77.

Next, a detailed explanation of an opening and closing operation of the lid 37 will be given.

FIG. 7 shows an open state of the lid 37. In order to set the lid 37 to a closed state, the lid 37 is rotated approximately 180° in a manner that closes the lid 37 with the hinge shaft 48 as a center of rotation thereof. When this is done, a leading end of the engagement portion 80 is pushed by a leading end of the engagement piece 68, and the engagement portion 80 moves to an outer side. The locking button 76 is inclined in concert with the engagement portion 80 moving to the outer side in this manner. Furthermore, when the lid 37 is pushed in a manner that closes the lid 37, the engagement piece 68 rides across the engagement portion 80, and a lower portion of the engagement portion 80 latches onto the engagement piece 68. As a result of this, the lid 37 is fixed with respect to the stopper main body 35. Further, by fitting the U-shaped lock 77 onto the latch reception portion 69 by rotating the U-shaped lock 77 upward with the lock rotation shaft 84 as the center of rotation thereof, the lid 37 reaches a completely locked state.

When the lid 37 is rotated in a manner that closes the lid 37 with the hinge shaft 48 as a center of rotation thereof, since the connection portion 64, which is formed in the cover member 53, abuts against the connection reception portion 73, the cover member 53 also rotates in the same direction as the lid 37 with the hinge shaft 48 as the center of rotation thereof. When this is done, since the latching groove 63, which is formed in the cover member 53, also rotates along with the rotation of the cover member 53, stress is applied to the arm portion 56 of the torsion spring 51, which is stored in the latching groove 63 in a direction of rotation. Thereby, a biasing force that is an inverse direction to the direction of rotation is generated by the elasticity of the torsion spring 51. In other words, when the lid 37 is in an open state, a biasing force is not generated by the torsion spring 51, but from a state when rotation of the lid 37 is started in the closing direction to a closed state thereof, a biasing force is generated by the torsion spring 51 in an opening direction of the lid 37.

In addition, if the lid 37 is rotated in a manner that closes the lid 37, the lid closure prevention plate 59 abuts against the lid closure prevention projection 58, but if the lid 37 is further rotated by a user, it is possible for the lid closure prevention plate 59 to easily ride across the lid closure prevention projection 58.

Meanwhile, in order to set the lid 37 that is in a closed state to an open state, the U-shaped lock 77, which is fitted onto the latch reception portion 69 that is formed in the lid 37 is pulled to the front side, and fitted onto the support portion 83 through rotation thereof to the lower side with the lock rotation shaft 84 as the center of rotation thereof. Next, if a lower side of the button portion 79 of the locking button 76 is pressed, the locking button 76 rotates with the lock rotation shaft 84 as the center of rotation thereof, the engagement portion 80 moves to the front side and is separated from the engagement piece 68, and the lock is released. As a result of this, the lid 37 rotates in an opening direction with the hinge shaft 48 as the center of rotation thereof due to the biasing force of the torsion spring 51. Further, the lid 37 reaches an open state when the lid closure prevention plate 59 rides across the lid closure prevention projection 58. Additionally, with respect to the lid 37, a state in which the lid top panel portion 66 abuts against the back side of the tubular portion 39 of the stopper main body 35 is a maximum open state.

In this manner, in the present example, a stopper 4 for a beverage container 1 includes: a stopper main body 35 that is attached to an upper opening 3 of a beverage container main body 2 and includes a liquid through hole 44 on the inside thereof; and a lid 37 that is axially supported by a hinge shaft 48 that is provided at an end of the stopper main body 35, and which opens and closes the liquid through hole 44 in a rotational manner; wherein the hinge shaft 48 connects a hinge portion 42 of the stopper main body 35, and right and left hinge portions 71 and 71 which are provided with the lid 37 so as to sandwich the hinge portion 42 of the stopper main body 35; a storage portion 50 is provided on at least one of the right hinge portion 71, the left hinge portion 71, and the hinge portion 42 of the stopper main body 35; a torsion spring 51 is stored in the storage portion 50; a cover member 53 covers an opening 52 of the storage portion 50;

the torsion spring 51 and the cover member 53 are integrated or engaged with the hinge portion 42 of the stopper main body 35 and the lid hinge portion 71 using the hinge shaft 48; arm portions 56, which are provided at both end portions of the torsion spring 51, are respectively freely fitted into a fixed groove 57 which is provided in the storage portion 50, and a latching groove 63 which is provided in the cover member 53; and the lid 37 is biased toward an opening direction as a result of causing a connection portion 64 of the cover member 53 to abut against a connection receiving portion 73 that is provided in one of the lid 37 and the stopper main body 35 which does not include the storage portion 50.

In this manner, exposure of the torsion spring 51 is reduced, and thereby, the external appearance is improved by accommodating or housing the torsion spring 51 in the storage portion 50.

Furthermore, by covering the storage portion 50 with the cover member 53, even in a case in which the torsion spring 51 breaks, fragments are stopped inside the storage portion 50, and therefore, it is possible to reduce the risk of fragments falling outside the storage portion 50.

In addition, in the present example, the latching groove 63 and the fixed groove 57 are not exposed to an outer surface regardless of the position of the lid 37. In other words, the fixed groove 57 and latching groove 63 with which the arm portions 56 of the torsion spring 51 are freely fitted are not exposed to an outer surface whichever position the lid 37 is in. Therefore, even in a case in which the arm portions 56 become broken, fragments are stopped inside the storage portion 50, and therefore, it is possible to reduce the risk of fragments falling outside the storage portion 50.

In addition, in the present example, the interval between the storage portion 50 and the cover member 53 is set to be less than or equal to the wire diameter of the torsion spring 51. As a result of this, even in a case in which the torsion spring 51 becomes broken, broken fragments do not fall inside the beverage container 1.

Additionally, the present disclosure is not limited to the abovementioned example, and various modification examples are possible within a range of the scope of the present disclosure. For example, in the example, the torsion spring, the cover member and the like were provided on the right hinge portion of the stopper main body, but may be provided on the left side of the hinge portion of the stopper main body, or provided on either the left side or the right side of the lid hinge portion.

While preferred embodiments of the disclosure have been described and shown above, it should be understood that these are exemplary examples of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

EXPLANATION OF REFERENCES

1 beverage container
2 beverage container main body
3 upper opening
4 stopper
35 stopper main body
37 lid
42 hinge portion of the stopper main body
44 liquid through hole
48 hinge shaft
50 storage portion
51 torsion spring
52 opening of the storage portion (storage opening)
53 cover member
56 arm part
57 fixed groove
63 latching groove
64 connection part
71 lid hinge part
73 connection reception part

What is claimed is:

1. A stopper for a beverage container comprising:

a stopper main body that attaches to an upper opening of a beverage container main body and comprises a liquid through hole on the inside thereof;

a lid that is axially supported by a hinge shaft that is provided at an end of the stopper main body, and which opens and closes the liquid through hole in a rotational manner;

wherein the hinge shaft connects a hinge portion of the stopper main body with right and left hinge portions of the lid, wherein the hinge portion of the stopper main body is axially aligned between the right and left hinge portions;

a storage portion is provided in the hinge portion of the stopper main body;

a torsion spring is housed in the storage portion;

a cover member covers an opening of the storage portion;

the torsion spring and the cover member are integrated with the hinge portion of the stopper main body and the right and left lid hinge portions by the hinge shaft, the cover member rotatable with respect to the hinge portion of the stopper main body; the hinge portion of the stopper main body and the cover member enclose the torsion spring; arm portions, which are provided at both end portions of the torsion spring, are respectively freely fitted into a fixed groove which is provided in the storage portion, and a latching groove which is provided in the cover member; and, the lid is biased toward an opening direction by a connection portion of the cover member abutting against a connection receiving portion of the lid.

2. The stopper for a beverage container according to claim 1, wherein the latching groove and the fixed groove are not exposed to an outer surface regardless of a position of the lid.

3. The stopper for a beverage container according to claim 1, wherein an interval between the storage portion and the cover member is less than or equal to a wire diameter of the torsion spring.

4. The stopper for a beverage container according to claim 1, wherein a lid closure prevention projection having a convex shape is formed on a back side of the outer surface of the hinge portion of the stopper main body, a thin plate-shaped lid closure prevention plate is formed on the lid; and the lid closure prevention plate abuts against the lid closure prevention projection.

5. A beverage container comprising the stopper according to claim 1.

6. A beverage container comprising the stopper according to claim 1, wherein the stopper main body attaches to the upper opening of the beverage container main body.

7. A stopper for a beverage container comprising:

a stopper main body comprising a liquid through hole;

a lid that is axially supported by a hinge shaft that is provided at an end of the stopper main body, and which opens and closes the liquid through hole in a rotational manner;

wherein the hinge shaft connects a hinge portion of the stopper main body with right and left hinge portions of the lid, wherein the hinge portion of the stopper main body is axially aligned between the right and left hinge portions;

a storage portion is provided in the hinge portion of the stopper main body;

a torsion spring is housed in the storage portion;

a cover member covers an opening of the storage portion, the opening of the storage portion positioned on either a right side of an axial direction of the torsion spring or on a left side of the axial direction of the spring, and the hinge portion of the stopper main body and the cover member enclose the torsion spring;

the torsion spring and the cover member are integrated with the hinge portion of the stopper main body and the lid hinge portion by the hinge shaft, the cover member rotatable with respect to the hinge portion of the stopper main body;

arm portions, which are provided at both end portions of the torsion spring, are respectively fitted to the storage portion and the cover member; and, the lid is biased toward an opening direction by a connection portion of the cover member abutting against a connection receiving portion of the lid.

* * * * *